United States Patent [19]

Fleischhauer

[11] Patent Number: 4,638,527

[45] Date of Patent: Jan. 27, 1987

[54] VACUUM CLEANER ATTACHMENTS

[76] Inventor: Eugene T. Fleischhauer, 1413 Wesanne La., Midlothian, Va. 23113

[21] Appl. No.: 886,399

[22] Filed: Jul. 17, 1986

Related U.S. Application Data

[62] Division of Ser. No. 832,173, Feb. 20, 1986.

[51] Int. Cl.[4] ..... A47L 9/06

[52] U.S. Cl. ..... 15/371; 15/374; 285/7

[58] Field of Search ..... 15/374, 371, 373; 285/7

[56] References Cited

U.S. PATENT DOCUMENTS

| | | | |
|---|---|---|---|
| 1,699,598 | 1/1929 | Lee . | |
| 1,708,194 | 4/1929 | Smidley . | |
| 1,725,762 | 8/1929 | Lee . | |
| 1,785,675 | 12/1930 | Cundiff . | |
| 1,926,798 | 10/1931 | Lee . | |
| 1,967,284 | 7/1932 | Smidley . | |
| 2,394,798 | 2/1946 | McNeal | 15/374 X |
| 2,396,862 | 3/1946 | Linderoth | 15/374 X |
| 2,519,741 | 8/1950 | Caughey . | |
| 2,554,238 | 5/1951 | Burri . | |
| 2,610,351 | 9/1952 | Lilly . | |
| 2,643,413 | 6/1953 | Buccasio . | |
| 2,679,068 | 5/1954 | Weid . | |
| 2,869,170 | 1/1959 | Wessel . | |
| 3,306,634 | 2/1967 | Groves et al. | 285/7 |
| 4,537,424 | 8/1985 | Maier et al. | 285/7 |

OTHER PUBLICATIONS

Advertisement, Hoover Quick-Broom, copyright 1983.

Advertisment, Sears Power-Mate Cannister Vacuum, The Washington Post, Feb. 22, 1985.

*Primary Examiner*—Chris K. Moore

*Attorney, Agent, or Firm*—Hughes & Cassidy

[57] ABSTRACT

Vacuum cleaner attachments which have a V-shaped cleaning head and are particularly suited for cleaning in corners and crevices and along the edges of surfaces. Vertically biased and rotatable brushes and other disturbers can be provided to promote the dislodgement of foreign substances from the surface being cleaned. A preferred universal-type connection between the cleaning head and a vacuum fitting attached thereto facilitate the manipulation of the attachment and allow pressure to be brought to bear on the nose of the cleaning head, thereby promoting the dislodgement of foreign substances from the surface being cleaned.

14 Claims, 7 Drawing Figures

VACUUM CLEANER ATTACHMENTS

CROSS REFERENCE TO RELATED APPLICATION

This application is a division of application Ser. No. 832,173 filed Feb. 20, 1986, by Eugene T. Fleischhauer for VACUUM CLEANERS ATTACHMENTS.

TECHNICAL FIELD OF IHE INVENTION

The present invention relates to vacuum cleaner attachments which are designed to easily and efficiently reach such hard-to-clean areas as: (1) corners and (2) the edges between, for example, a floor and a wall, two walls, or a wall and a ceiling. The principles of the present invention may also be employed in attachments designed to clean furniture and other artifacts and constructed to reach into crevices, corners, etc. of such artifacts.

BACKGROUND OF IHE INVENTION

As will be appreciated by those to whom this specification is particularly addressed, corners, edges, etc. are particularly difficult to reach with conventional upright vacuum cleaners and with dusting and floor brushes and other conventional vacuum cleaner attachments. And special purpose attachments such as crevice tools are inconvenient to use and time consuming in applications such as the cleaning of the edges of a large room.

SUMMARY OF THE INVENTION

I have now invented novel vacuum cleaner attachments which allow corners, edges, and other hard-to-reach areas to be cleaned rapidly and with ease. These novel implements can be attached to the wands or hoses of cannister type vacuum cleaners and to the same components of upright vacuum cleaners. They can also be attached directly to, or integrated into, stick-type vacuum cleaners such as the Hoover Quick-Broom.

In general, the novel vacuum cleaner attachments that I have invented have a V-shaped configuration when viewed from above. This configuration is attributable to two legs or wings which define downwardly opening, U-sectioned vacuum or suction chambers and meet at an angle (typically 90°) to form a sharp nose that can reach into corners and closely follow the edges of the surface being cleaned. Downwardly biased and freewheeling brushes can be mounted in the vacuum chambers to dislodge dirt and other foreign substances from the surface being cleaned, and wheels and other ground-engaging components can be provided to space the vacuum chamber defining legs in the proper relation to the surface being cleaned and/or to facilitate the movement of the attachment across that surface.

The vacuum or suction chambers in the V-shaped cleaning head are connected to a vacuum source—typically a wand—via a tubular vacuum fitting. Preferably, a universal connection is provided between the fitting and the cleaning head to facilitate the manipulation of the attachment. And the tubular fitting may be configured so that pressure may be brought to bear on the nose of the cleaning attachment, thereby promoting the removal of foreign substances from the surface being cleaned.

Several direction related terms such as bottom, lower, etc. will be used hereinafter. These terms are employed on the premise that the attachment being described is resting on a horizontal surface. They are furthermore employed solely for the sake of convenience and clarity and are not intended to impose any limitation on the scope of my invention as defined in the appended claims.

THE PRIOR ART

Vacuum cleaner attachments and vacuum cleaners with cleaning heads superficially resembling those I have invented and/or said to be useful for edge cleaning are described and illustrated in an advertisement for a Hoover Quik-Broom copyrighted in 1983; in an advertisement for a Sears Power-Mate vacuum cannister appearing in the Feb. 22, 1985, edition of the Washington Post; and in the following U.S. Pat. Nos.:

| U.S. Pat. No. | Patentee | Issue Date |
|---|---|---|
| 1,699,598 | Lee | January 22, 1929 |
| 1,708,194 | Smidley | April 9, 1929 |
| 1,725,762 | Lee | August 27, 1929 |
| 1,785,675 | Cundiff | December 16, 1930 |
| 1,826,798 | Lee | October 13, 1931 |
| 1,867,284 | Smidley | July 12, 1932 |
| 2,519,741 | Caughey | August 22, 1950 |
| 2,554,238 | Burri | May 22, 1951 |
| 2,610,351 | Lilly | September 16, 1952 |
| 2,643,413 | Buccasio | June 30, 1953 |
| 2,679,068 | Wied | May 25, 1954 |
| 2,869,170 | Wessel | January 20, 1959 |
| 3,585,670 | MacKinnon | June 22, 1971 |

As suggested above, however, the resemblances between the devices disclosed in the just-cited references and the novel vacuum cleaner attachments I have invented are no more than superficial. While the Lee '598, Smidley '194, Lee '762, Cundiff '675, Lee '798, Smidley '284, and Caughey patents disclose vacuum cleaning devices with cleaning heads which resemble applicant's novel vacuum cleaning attachments to the extent that they have a V- or V-like configuration, this is as far as the resemblance goes. The cleaning heads of the implements disclosed in the foregoing patents are integral vacuum cleaner components and not attachments. Consequently, they are not as easy to manipulate as my novel attachments; and, unlike the latter, they cannot be used to clean walls, ceilings, furniture, etc.

The remainder of the above-cited references do disclose vacuum cleaner attachments with the exception of the Hoover Quick-Broom advertisement. That advertisement discloses a vacuum cleaner which can be handled much like the wand of a cannister or hose-equipped upright vacuum cleaner. However, the implements disclosed in the two advertisements lack the V-shaped configuration found necessary by applicant for efficient edge and corner cleaning, the downwardly biased and freewheeling brushes, and the universal connections which make it possible to so easily and deftly manipulate applicant's novel vacuum cleaner attachments.

OBJECTS OF THE INVENTION

From the foregoing it will be apparent to the reader that one important and primary object of my invention resides in the provision of novel, improved vacuum cleaner attachments.

Other also important but more specific objects of my invention reside in the provision of vacuum cleaner attachments as aforesaid:

which are capable of cleaning effectively in corners and along edges such as those between a floor or ceiling and a wall and those between two walls;

which can be used both with cannister type vacuum cleaners and with upright cleaners equipped with a wand;

which provide for universal movement of the attachment relative to the wand or other fixture to which it is attached, thereby facilitating the manipulation of the attachment by the user of the vacuum cleaner;

which incorporate brushes that are rotatable in a manner that effectively dislodges foreign substances from the surface being cleaned;

which combine the functions of a conventional crevice tool and an upright vacuum cleaner or a general cleaning tool such as a carpet or floor cleaning vacuum cleaner attachment;

which are particularly useful in cleaning around area rugs;

which are versatile in that they can be employed to clean such diverse artifacts as bare floors, rugs and carpets, walls, ceilings, cornices and other moldings, and furniture;

which can be coupled to the vacuum inlet of a stick-type vacuum cleaner as well as to the wand of a cannister or upright type vacuum cleaner.

Other important objects and feature and additional advantages of my invention will be apparent to the reader from the foregoing and the appended claims and as the ensuing detailed description and discussion of the invention proceeds in conjunction with the accompanying drawing.

DETAILED DESCRIPTION OF THE INVENTION

Figures 1, 3:
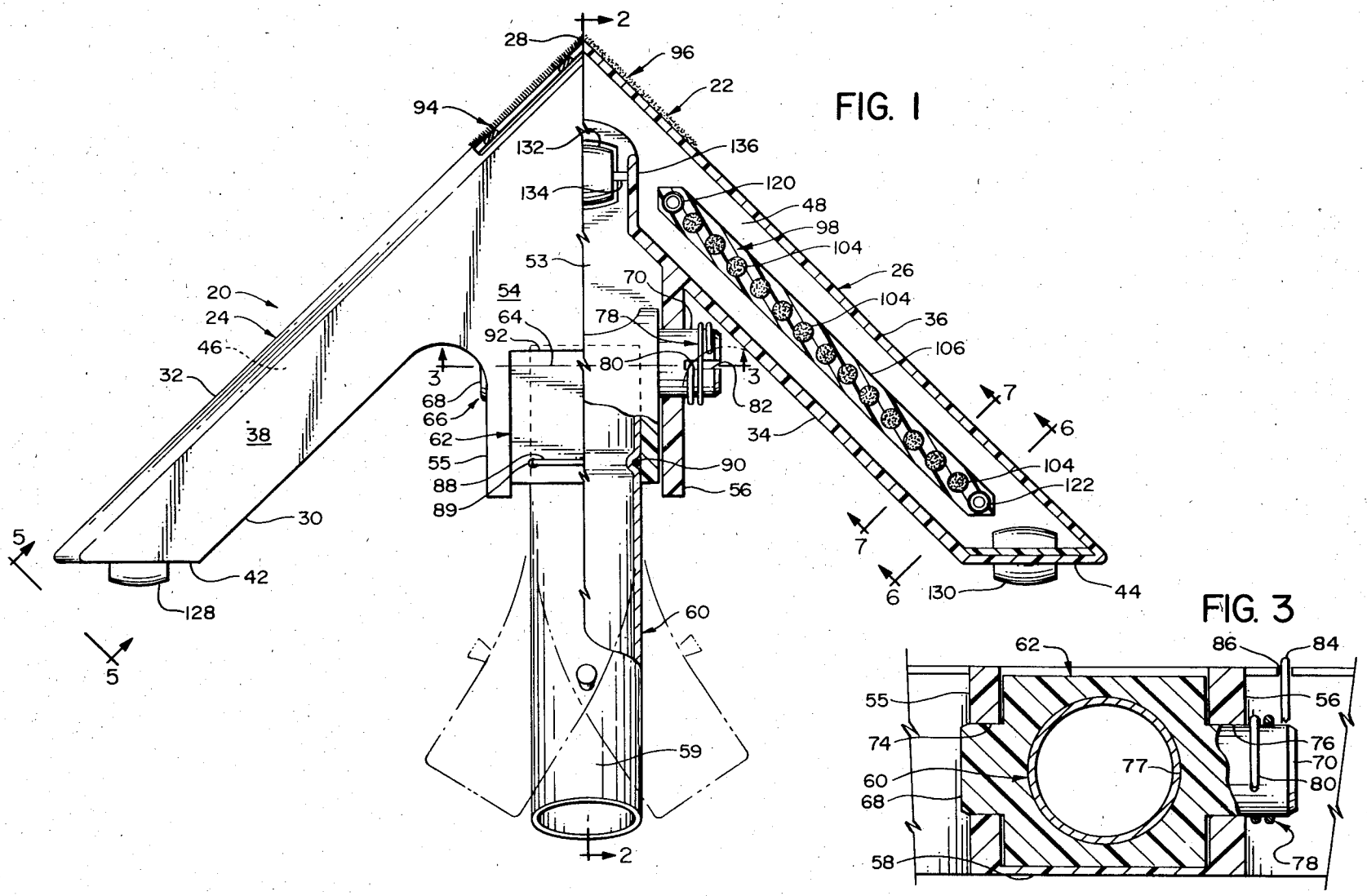
FIG. 1 is a plan view of a vacuum cleaner attachment embodying, and constructed in accord with, the principles of the present invention.
FIG. 3 is a section through the vacuum cleaner attachment of FIG. 1, taken substantially along line 3—3 of the latter figure.

Referring now to the drawing, FIGS. 1–7 show, in detail, the construction of a vacuum cleaner attachment 20 embodying, and constructed in accord with, the principles of the present invention.

Essential to attachment 20 is a V-shaped housing 22 with two integral wings 24 and 26 which meet at the forward end of the attachment at an angle of (typically) 90°. This forms a sharp nose 28 which can reach into corners and other spots that are inaccessible to a typical conventional vacumm cleaner or vacuum cleaner attachment.

The two wings 24 and 26 of the housing have parallel, spaced apart, vertically extending inner and outer side walls 30, 32 and 34, 36. Because the outer side walls 32 and 36 are straight, attachment 20 can also closely follow the edge of a room being cleaned, for example.

In addition to the just-identified inner and outer walls 30, 32 and 34, 36, the wings 24 and 26 of housing 22 include flat, horizontal top walls 38 and 40 and rear walls 42 and 44 which cooperate with the inner and outer side walls to form vacuum chambers 46 and 48 having an inverted-U cross-sectional configuration. These vacuum chambers are open at the lower edges 50 and 52 of wings 24 and 26.

Communicating with vacuum chambers 46 and 48 in the two wings 24 and 26 of vacuum attachment 20 is a vacuum plenum 53. That plenum is defined by an integral section of housing 22 which has a top wall 54, side walls 55 and 56, and a bottom wall 58. This part of the housing is centered on the fore-to-aft centerline 59 of attachment 20 and extends toward the rear of the attachment from the intersection at the nose of the attachment between the two inner walls 30 and 34 of the attachment's two wings 24 and 26.

The vacuum chambers 46 and 48 in the two wings 24 and 26 of attachment 20 are connected at their forward ends through plenum 53 to a vacuum source (not shown) by a tubular vacuum fitting 60. This fitting has a rear section 61 that is inclined upwardly to facilitate its attachment to the lower end of a conventional vacuum cleaner wand and to allow downward pressure to be exerted on attachment 20. Fitting 60 is housed for rotation about the longitudinal centerline 59 of attachment 20 in, and detachably fixed to, a vacuum fitting support 62. The latter is supported from the vacuum plenum defining side walls 55 and 56 of housing 22 for rotation about a transversely extending, horizontal pivot axis 64 by a pivot member 66. This results in a universal type connection between fitting 60 and housing 22. The connection facilitates the manipulation of the vacuum cleaner attachment 20.

It is preferred that the transverse axis 64 about which the vacuum fitting is vertically pivoted be located about one-third of the fore-to-aft distance between the nose and rear end of the attachment. This also allows the operator to exert downward pressure on the attachment to thereby promote its cleaning efficiency.

As is perhaps best shown in FIG. 3, pivot member 66 is made up of two transversely extending, circularly sectioned, pivot lugs 68 and 70 which are integral components of vacuum fitting support 62 and are rotatable about transverse axis 64, which lies in the vertical midplane of housing 22. The two pivot lugs 68 and 70 extend through openings 74 and 76 in the vertical, plenum defining side walls 55 and 56 of vacuum cleaner attachment housing 22. This rotatably journals the lugs in those side walls.

The above-mentioned vacuum fitting support 62 has a generally rectangular section and a central, fore-and-aft extending passage 77. That passage provides fluid communication between vacuum fitting 60 and the plenum 53 which connects the latter to those vacuum chambers 46 and 48 in the two wings 24 and 26 of housing 22.

Housing 22 is biased downwardly relative to fitting 60 by a spring 78 coiled around pivot lug 70. One end 80 of this spring is fitted into a slot 82 through pivot lug 70. The other end 84 of spring 78 is fitted into a slot 86 through the vacuum plenum defining top wall 54 of vacuum attachment housing 22. This gives spring 78 a tendency to unwind which furnishes the bias just discussed and thereby tends to keep the lower edges 50 and 52 of the vacuum cleaner attachment wings 24 and 26 flat against the surface being cleaned.

Vacuum fitting 60 is detachably secured in support 62 by a conventional expandable retainer ring 88. The retainer ring is fastened to support 62 by passing the ring through apertures 89 in vacuum fitting support 62 (only one of which is shown) so that the ring lies partly without and partly within the support. Interiorly of the vacuum fitting support, retainer ring 88 fits into a circumferential recess 90 located in the forward end 92 of vacuum fitting 60.

Figures 2, 4, 5, 6, 7:
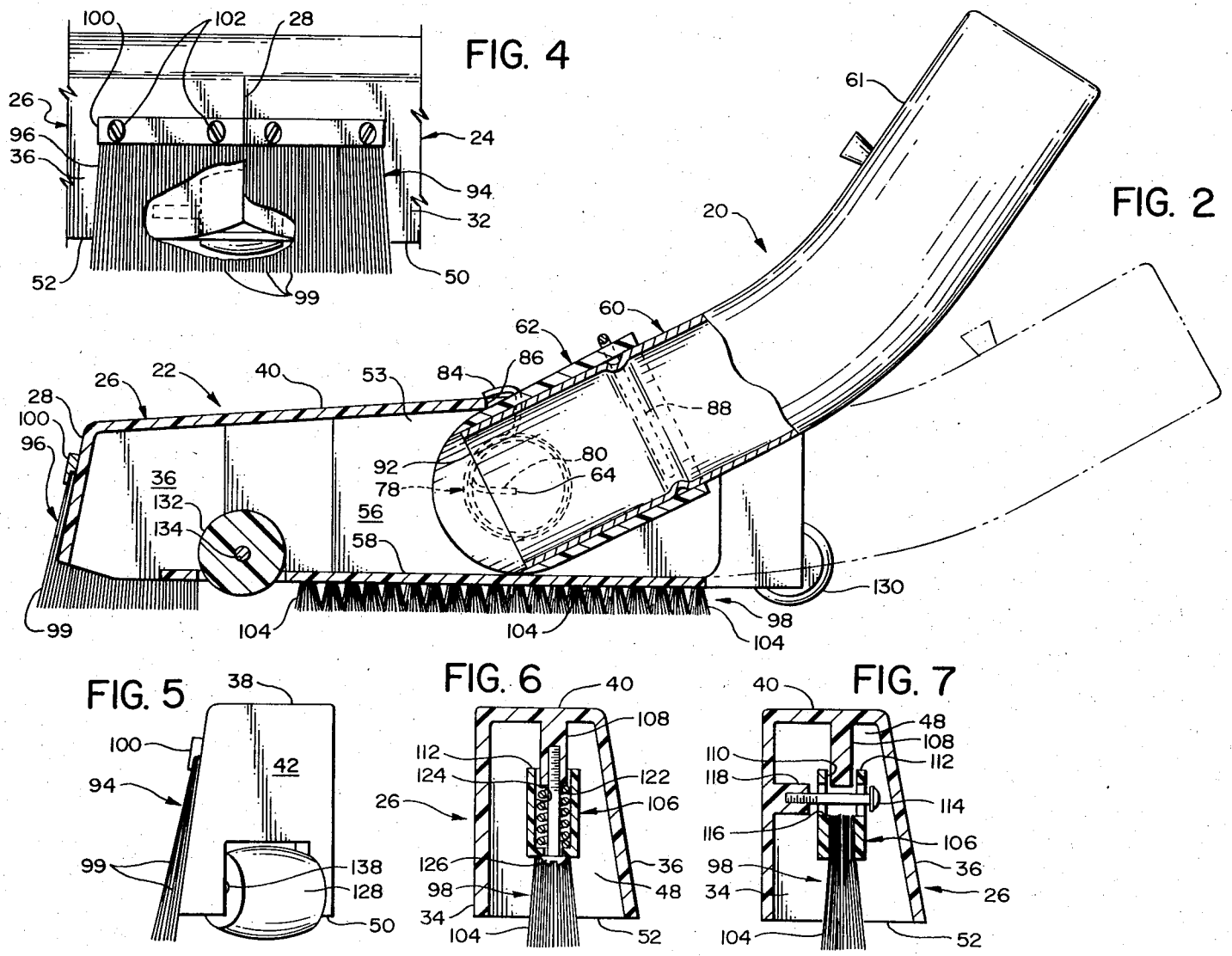
FIG. 2 is a longitudinal section through the vacuum cleaner attachment of FIG. 1, taken substantially along line 2—2 of that figure.
FIG. 4 is a partial front elevation of the vacuum cleaner attachment.
FIG. 5 is an elevation of the attachment, taken substantially along line 5—5 of FIG. 1.
FIGS. 6 and 7 are sections through the vacuum cleaner attachment, taken substantially along lines 6—6 and 7—7 of FIG. 1.

Limits on the vertical, pivotal movement of vacuum fitting 60 are shown in FIG. 2. Orientations to which it can be rotated about the fore-and-aft centerline 59 of vacuum cleaner attachment 20 are shown in solid and phantom lines in FIG. 1.

As suggested by the foregoing description of attachment 20, the vacuum chambers 46 and 48 in its two wings 24 and 26 communicate with the surface on which the attachment is deployed, and vacuums are generated in these two chambers by way of vacuum plenum 53 and vacuum fitting 60. Consequently, foreign substances loose on, or dislodged from, that surface are propelled through those chambers, the vacuum plenum, vacuum fitting 60, and a wand, hose, or the like to a collection point, typically in a disposable or other vacuum cleaner bag.

To dislodge foreign substances from the surface being cleaned, vacuum cleaner attachment 20 is preferably equipped with vertically depending brushes 94 and 96, which protrude beyond the lower edge of attachment housing 22 at the nose 28 of the attachment, and with similarly oriented and protruding brushes in those vacuum chambers 46 and 48 located in the two wings 24 and 26 of the attachment. One of the latter brushes is shown in FIGS. 1, 2, 6, and 7 and identified by reference character 98.

The two brushes 94 and 96 at the nose end of the vacuum cleaner attachment each have bristles 99 fixed to a holder 100. The latter is secured to the outer, vertically depending wall 32 or 36 of the wing 24 or 26 with which it is associated as by conventional screws 102.

Each of the two vacuum chamber housed brushes includes bundles 104 of bristles spaced along, and fixed at their upper ends to, a holder 106. The holder is located midway between, and parallel to, the inner and outer walls 30 and 32 or 34 and 36 of the vacuum cleaner attachment wing 24 or 26 in which the brush is located. As best shown in FIG. 1, these brushes extend generally from end-to-end of the wing in which they are housed.

To accommodate attachment 20 to surfaces of different textures, the two brushes housed in the wings 24 and 26 of the vacuum cleaner attachment are mounted for vertical displacement in the wings of housing 22 and are biased toward the lower ends of those wings. The mounting and biasing arrangements are shown in FIGS. 7 and 6, respectively.

Turning first to the former, both brushes are mounted on guides depending from, and integral with, an attachment wing top wall 38 or 40. One of these guides is illustrated in FIG. 7 and identified by reference character 108.

The brush guides fit into vertical recesses opening onto the top wall of the holder component 106 of the involved brush. In FIG. 7, one such recess is identified by reference character 110; and the top wall of the brush holder is identified by reference character 112.

As shown in the same figure, the brushes such as that identified by reference character 98 are secured in place by screws 114. These screws extend through elongated, vertical displacement accommodating slots 116 in brush holder 106 and are threaded into an integral boss 118. That boss extends inwardly, and horizontally, from the inner vertical wall 30 or 34 of a vacuum cleaner attachment wing 24 or 26.

Turning now to FIG. 6, springs 120 and 122 at the forward and rear ends of the two vacuum chamber-housed brushes bias those brushes toward the surface being cleaned. These springs are housed in upwardly opening recesses in brush holder 106. One of these spring housing recesses is shown in FIG. 6 and identified by reference character 124.

A screw 126 extends upwardly through the brush holder 106 and is threaded into the guide or boss 108 integrally depending from the vacuum chamber defining top wall 38 or 40. That limits the downward travel of the spring 120 or 122, which is compressed between the lower end of boss 108 and the bottom end of the recess 124 in which it is housed.

Vacuum cleaner attachment 22 is made mobile by wheels 128 and 130 at the trailing or aft ends of vacuum chamber defining wings 24 and 26 and by a third wheel 132 at the nose 28 of attachment 20.

Wheel 132 is mounted on a transversely extending axle 134. The axle is rotatably supported in integral extensions at the forward ends of vacuum chamber defining inner walls 30 and 34. One of these extensions is shown in FIG. 1 and identified by reference character 136.

The two wheels 128 and 130 at the aft end of the attachment are supported by axles from the inner and outer, vacuum chamber defining side walls 30, 32 or 34, 36 of the attachment's two wings 24 and 26. One of these two axles is identified by reference character 138 in FIG. 5.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description; and all changes which come within the meaning and range of equivalency of the claims are therefore intended to be embraced herein.

What I claim as my invention is:

1. A vacuum cleaner attachment which is particularly adapted to reach into corners and crevices and to reach along walls, said attachment comprising: a V-shaped housing having a pair of legs which meet and form a sharp nose at the forward end of the attachment, said legs each having inner, outer, top, and rear walls which cooperate to form an elongated, open bottom vacuum chamber with an inverted U cross-section; a tubular vacuum fitting in communication at its forward end with the vacuum chambers in the first and second legs at the nose of said V-shaped housing; a support for said vacuum fitting which defines a vacuum plenum which provides fluid communication between said vacuum fitting and the vacuum chambers in the legs of said housing; a cleaning brush extending longitudinally along and housed in each of said vacuum chambers, said brushes having bristles which are adapted to come into contact with and dislodge foreign substances from a surface being cleaned; means at the opposite ends of said brushes for mounting the brushes in the vacuum chambers formed in the legs of said housing for vertical movement therein; and means at said opposite ends of said brushes for biasing said ends of brushes toward the open lower sides of said legs of said housing.

2. A vacuum cleaner attachment as defined in claim 1 which has wheels for facilitating the movement of said attachment over the surface being cleaned and for establishing a fixed spatial relationship of said housing above said surface and thereby promoting the sweeping action of said brushes, there being one wheel at the nose of said housing and one wheel at the trailing edge of each of the legs of said housing.

3. A vacuum cleaner attachment as defined in claim 2 which has means fixed to the forward end of said vacuum fitting support for supporting said one wheel from said housing.

4. A vacuum cleaner attachment as defined in claim 1 which includes vertically depending brushes fixed to the outer walls of the legs of said housing at the nose of the housing.

5. A vacuum cleaner attachment as defined in claim 1 wherein said vacuum fitting support is fixed to the inner walls of the legs of the V-shaped housing at the forward end of said housing.

6. A vacuum cleaner attachment which is particularly adapted to reach into corners and crevices and to reach along walls, said attachment comprising: a V-shaped housing having a pair of legs which meet and form a sharp nose at the forward end of the attachment, said legs each having inner, outer, top, and rear walls which cooperate to form an elongated, open bottom vacuum chamber with an inverted U cross-section; a tubular vacuum fitting; means defining a vacuum plenum which provides fluid communication between said vacuum fitting and the vacuum chambers in the legs of said housing, said vacuum plenum defining means being fixed to the inner walls of said legs only at the nose of said attachment; a support for said vacuum fitting, said vacuum fitting support being rotatable relative to said V-shaped housing of the attachment about a transverse horizontal axis; and said support including means mounting said vacuum fitting therein for rotary movment about the longitudinal centerline of said attachment.

7. A vacuum cleaner attachment as defined in claim 6 which includes vertically depending brushes fixed to the outer walls of the legs of said housing at the nose of the housing.

8. A vacuum cleaner attachment as defined in claim 6 wherein the rear portion of said vacuum fitting is inclined upwardly relative to the forward portion of the fitting to facilitate the manipulation of said attachment and the exertion of pressure on the forward end of the attachment.

9. A vacuum cleaner attachment as defined in claim 6 wherein the first and second legs of the V-shaped housing meet in a right angle.

10. A vacuum cleaner attachment as defined in claim 6 which includes means operatively connected between the housing of the attachment and the vacuum fitting support for biasing said housing downwardly relative to said vacuum fitting and thereby keeping the lower edges of said housing flat against the surface being cleaned.

11. A vacuum cleaner attachment as defined in claim 6 which includes an annular recess in said vacuum fitting and aperture means in said vacuum fitting support and a retainer ring for detachably fixing said vacuum fitting to said vacuum fitting support, said retainer ring being seated in said annular recess to detachably connect said ring and fitting together and a portion of said ring extending through said aperture means to thereby couple said ring to said support.

12. A vacuum cleaner attachment as defined in claim 6 wherein each of said brushes comprises a holder and bristles fixed to and depending from said holder, there being an aperture extending vertically through said holder at each end thereof, there being guides depending from the top wall defining the vacuum chamber in which the brush is housed and into said apertures to guide said brush in a vertical path, and each said means for mounting said brushes for vertical movement in the legs of said housing comprising a retainer means which extends upwardly through one of the aforesaid apertures and is fixed to the guide in said aperture.

13. A vacuum cleaner attachment as defined in claim 12 which includes, at each of the two ends of each brush, means biasing that brush toward the bottom of the vacuum chamber in which the brush is housed to thereby promote contact between the bristles of that brush and a surface being cleaned, each said biasing means comprising a spring which is housed in an aperture extending vertically through the brush holder as aforesaid, said spring surrounding the retainer in said aperture and being trapped between the bottom of said brush holder and said guide.

14. A vacuum cleaner attachment as defined in claim 12 which comprises, at each end of each brush, an integral boss extending horizontally into the vacuum chamber and a retainer extending through said brush holder and fixed to said boss for securing the brush in place, there being a vertically extending slot in said brush holder through which each said retainer extends to accommodate vertical movment of the brush as aforesaid.

* * * * *